US006672780B2

(12) United States Patent
Yehl et al.

(10) Patent No.: US 6,672,780 B2
(45) Date of Patent: Jan. 6, 2004

(54) THERMAL PRINTHEAD MECHANISM

(75) Inventors: Gregory C. Yehl, Snellville, GA (US); Michael Scott Adams, Cumming, GA (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 09/960,050

(22) Filed: Sep. 21, 2001

(65) Prior Publication Data

US 2003/0059241 A1 Mar. 27, 2003

(Under 37 CFR 1.47)

(51) Int. Cl.[7] ..... B41J 11/20
(52) U.S. Cl. ..... 400/58; 400/56; 400/55
(58) Field of Search ..... 400/55, 56, 58, 400/354, 120.01

(56) References Cited

U.S. PATENT DOCUMENTS

| | | | | |
|---|---|---|---|---|
| 3,134,254 | A | | 5/1964 | Richard |
| 3,392,558 | A | | 7/1968 | Hedin et al. |
| 3,930,304 | A | | 1/1976 | Keller et al. |
| 4,437,229 | A | | 3/1984 | Bitler et al. |
| 4,456,799 | A | * | 6/1984 | Haskins ..... 200/5 R |
| 4,706,096 | A | | 11/1987 | Sato |
| 4,740,066 | A | | 4/1988 | Whitehead |
| 4,750,880 | A | * | 6/1988 | Stephenson et al. ... 400/120.16 |
| 4,820,064 | A | | 4/1989 | Sato et al. |
| 5,013,387 | A | | 5/1991 | Goodwin et al. |
| 5,015,324 | A | | 5/1991 | Goodwin et al. |
| 5,024,541 | A | | 6/1991 | Tsukada et al. |
| 5,051,009 | A | | 9/1991 | Sugiura et al. |
| 5,056,940 | A | | 10/1991 | Basile |
| 5,078,523 | A | | 1/1992 | McGourty et al. |
| 5,237,487 | A | | 8/1993 | Dittmer et al. |
| 5,352,049 | A | | 10/1994 | Shiraishi et al. |
| 5,358,798 | A | | 10/1994 | Kleinert, III et al. |
| 5,411,339 | A | | 5/1995 | Bahrabadi et al. |
| 5,421,745 | A | | 6/1995 | Aksoy et al. |
| 5,435,657 | A | | 7/1995 | Pearce et al. |
| D361,342 | S | | 8/1995 | Hattori et al. |
| 5,472,804 | A | | 12/1995 | Austin et al. |
| 5,533,818 | A | | 7/1996 | Bahrabadi |
| D373,791 | S | | 9/1996 | Nobata |
| D376,796 | S | | 12/1996 | Hirasawa |
| 5,587,250 | A | | 12/1996 | Thomas et al. |
| 5,618,119 | A | | 4/1997 | Misu et al. |
| 5,645,360 | A | | 7/1997 | Iwane et al. |
| 5,670,266 | A | | 9/1997 | Thomas et al. |
| 5,674,013 | A | * | 10/1997 | Koike et al. ..... 400/120.16 |
| 5,694,159 | A | * | 12/1997 | Kajiya et al. ..... 347/197 |
| 5,709,486 | A | | 1/1998 | Day |
| 5,800,937 | A | | 9/1998 | Decker et al. |
| 5,823,689 | A | | 10/1998 | Nehowig et al. |
| 5,896,080 | A | | 4/1999 | Chen |
| 5,938,351 | A | | 8/1999 | Hamisch, Jr. et al. |
| 5,951,177 | A | | 9/1999 | Schanke et al. |
| 5,961,228 | A | | 10/1999 | Ward et al. |
| 5,964,539 | A | | 10/1999 | Yamaguchi et al. |
| 6,019,526 | A | * | 2/2000 | Herbert ..... 400/58 |
| 6,042,280 | A | | 3/2000 | Yamaguchi et al. |
| 6,116,796 | A | | 9/2000 | Yamaguchi et al. |
| 6,132,120 | A | | 10/2000 | Yamaguchi et al. |
| 6,394,672 | B1 | * | 5/2002 | Murray et al. ..... 400/58 |

* cited by examiner

*Primary Examiner*—Andrew H. Hirshfeld
*Assistant Examiner*—Dave A. Ghatt
(74) *Attorney, Agent, or Firm*—Robert A. McCann; Jay A. Saltzman; Christopher S. Clancy

(57) ABSTRACT

The invention is a thermal printhead mechanism having a stationary spring channel, a top bracket supported by the spring channel, and a printhead mounted to the top bracket. Additionally, the invention may include a cam, a bottom bracket, and a front mounting plate.

8 Claims, 3 Drawing Sheets

THERMAL PRINTHEAD MECHANISM

RELATED APPLICATIONS

This disclosure is related to the following U.S. patent applications filed on the same date as this application, each of which is owned by the assignee of this application, and the entirety of each of which is hereby incorporated herein by reference: U.S. Patent Application entitled "Media Cartridge with Printed Circuit Board for Use in a Printing System," naming Anthony E. Clayvon and James J. McElligott as an inventor.

FIELD OF INVENTION

The present invention relates generally to the field of thermal printing. More particularly, it relates to an improved printhead mechanism featuring a floating printhead that can be used to maintain the alignment between a printhead and a platen.

BACKGROUND OF THE INVENTION

Thermal printing is a non-impact method of imprinting images on paper and synthetic film. The process applies heat from a thermal printhead onto a thermal material and since thermal printers typically have fewer moving components, they are very reliable, clean, quiet, and easy to maintain. As a result, thermal printing is currently one of the most popular methods used for producing high quality, free format, random, on demand printed images.

The oldest and best known use of thermal printing is the direct thermal printing used in facsimile machines. However, consistently advancing technology has led to a proliferation of important new uses ranging from cash register receipts, tickets, anti-forgery labels, and meteorological plotting. Furthermore, the high image quality that is created with thermal printing makes this technology particularly well suited for printing bar code symbols.

In direct thermal printing, the print mechanism is primarily comprised of a thermal printhead that has a large number of tiny resistors that individually react to convert an electrical impulse into heat. The heat from the thermal printhead creates a reaction with a chemical coating on the thermal material (often paper) to produce an image. The print mechanism for thermal transfer printing is very similar to a direct thermal printer, with the addition of a ribbon supply and take-up mechanism.

The heart of both the direct thermal printing mechanism and thermal transfer printing mechanism is the thermal printhead which provides the heat energy necessary to form an image. Thermal printheads known in the prior art are typically linear thermal array types that are fixed in a secure position and create an image on a media as that media moves past the printhead. In this type of arrangement, the printhead is wide enough to span the entire width of the media that is printed upon, and a support platen behind the media is used to keep the media in contact with the printhead. Since the print element is fixed with regard to the media motion direction, print accuracy is superior. This superior print accuracy is what makes thermal printers one of the most widely used methods of printing machine readable bar codes.

In thermal printing, the most critical factor to the correct operation of the printer is the relationship between the printhead and the support platen behind the media. It is critical that the thermal printing elements are located perpendicular to the centerline of the cylindrical platen and that a proper pressure is maintained between the printhead, ribbon, and media. If the printing elements are not located on the centerline of the cylindrical platen, the elements will not create the same size dot on the printed media.

While thermal printing generally produces a high quality printed product, the fixed printhead disclosed in the prior art cannot accommodate the wide variety of different media thicknesses. Pivoted printheads were developed as a solution to this lack of versatility. In the prior art, a pivoted printhead, like the one disclosed in U.S. Pat. No. 5,051,009, is generally fixed only at a pivot point. Opposite the pivot point, the printhead is spring biased toward the platen roller thus allowing the printhead to move toward or away from the platen as necessary to accommodate varying media thicknesses. As the thickness of the media changes, however, the alignment of the pivoting printhead and the roller changes, negatively affecting print quality. Furthermore, in both a fixed printhead and a pivoting printhead thermal printer, the printhead and the platen roller are forced to be parallel. As a result of the required parallel orientation, if the platen roller and the printhead are even slightly misaligned during manufacture or if the media being used has an inconsistent or uneven thickness, the contact pressure of the printhead across the media will be uneven and the print quality will be inconsistent across the full length of the print line. Accordingly, there is a demand for an improved thermal printhead mechanism.

SUMMARY OF THE INVENTION

The present invention overcomes the deficiencies of the prior art by providing an improved printhead mechanism. In accordance with the present invention, the improved printhead mechanism comprises a printhead mounted on a top bracket, a bottom bracket supported by the top bracket, and a fixed spring channel that moveably supports the top bracket. In one embodiment of the invention, the spring channel is fixed to a front mounting plate and supports the top bracket and printhead through the use of a plurality of compression type springs. The compression type springs act to bias the floating printhead toward a platen roller in order to maintain a consistent pressure between the floating printhead and the print media. One embodiment of the present invention also provides for a cam located between the spring channel and a bottom bracket in order to provide a simple mechanism for loading and locking a printer ribbon and print media.

It is another feature of the invention to provide a method of maintaining the alignment between a printhead and a platen roller in a thermal printing device. According to the method, a spring channel is fixed in a permanent location and used to moveably support a top bracket upon which a printhead is mounted. One embodiment of the present method also provides for a plurality of compression type springs to be used to moveably support the top bracket.

By fixing the spring channel in a permanent location and allowing the printhead to float upon the support provided by the spring channel, the present invention is able to accommodate a wide variety of print media thicknesses. In addition, since the present invention allows the printhead to float on the support of the spring channel instead of being fixed or pivoting around a fixed point, it does not need to remain parallel to a platen roller in order maintain the contact pressure of the printhead across an uneven media. Accordingly, the claimed invention is more versatile and provides more consistent print line and overall print quality over a greater variety of medias than the thermal printing mechanisms available in the prior art.

These and other features and advantages of the present invention will be apparent to those skilled in the art upon review of the following detailed description of the drawings and preferred embodiments.

DETAILED DESCRIPTION OF PREFERRED EMBODIMENTS

Figure 1:
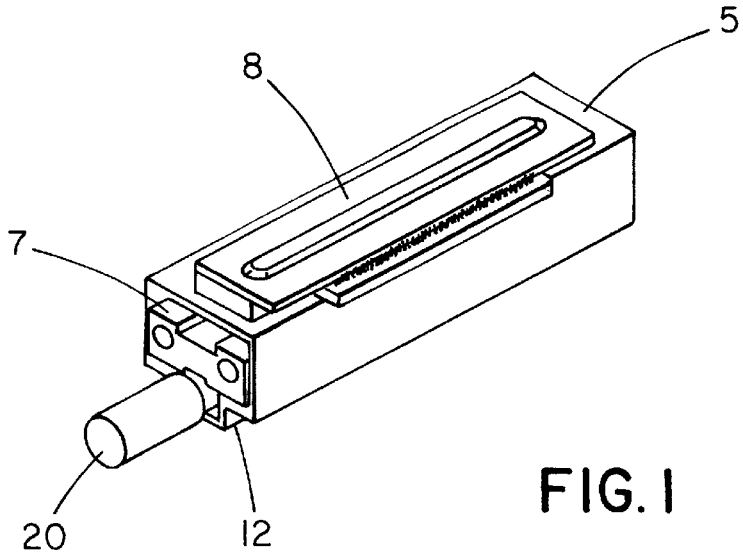
FIG. 1 is a perspective view of a thermal printhead mechanism in accordance with the claimed invention.
Figure 2:
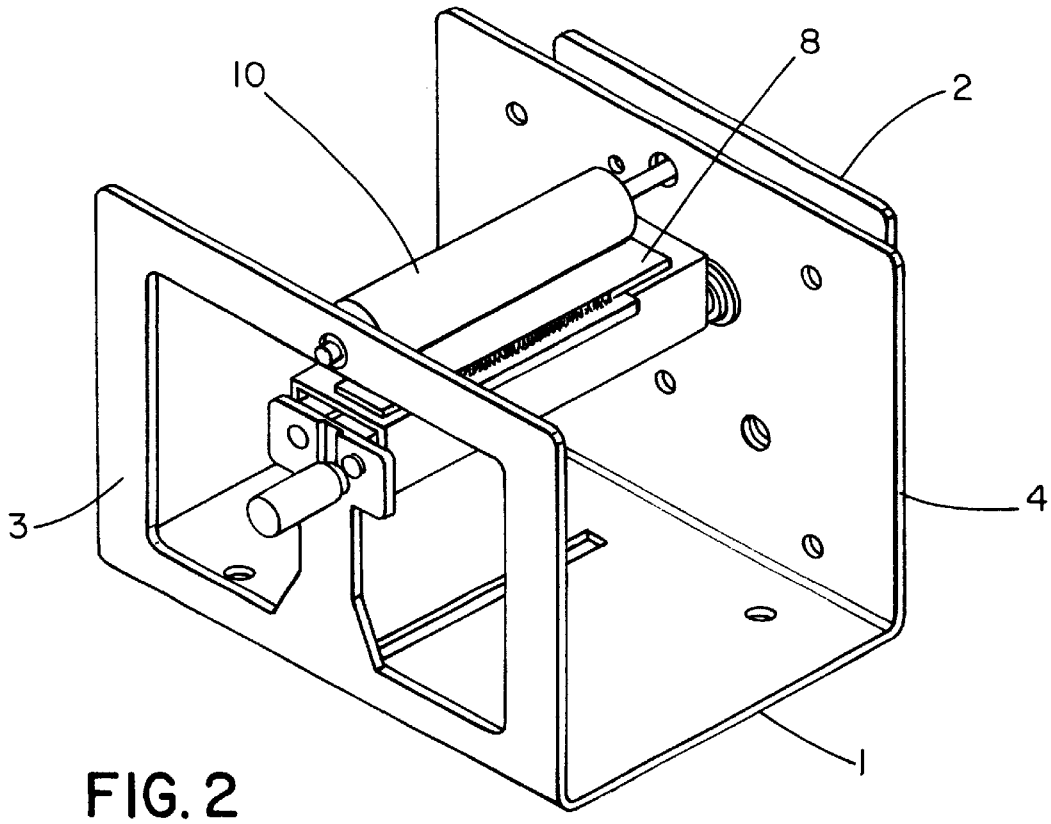
FIG. 2 is a perspective view of a printhead mechanism assembly in accordance with the claimed invention.
Figure 3:
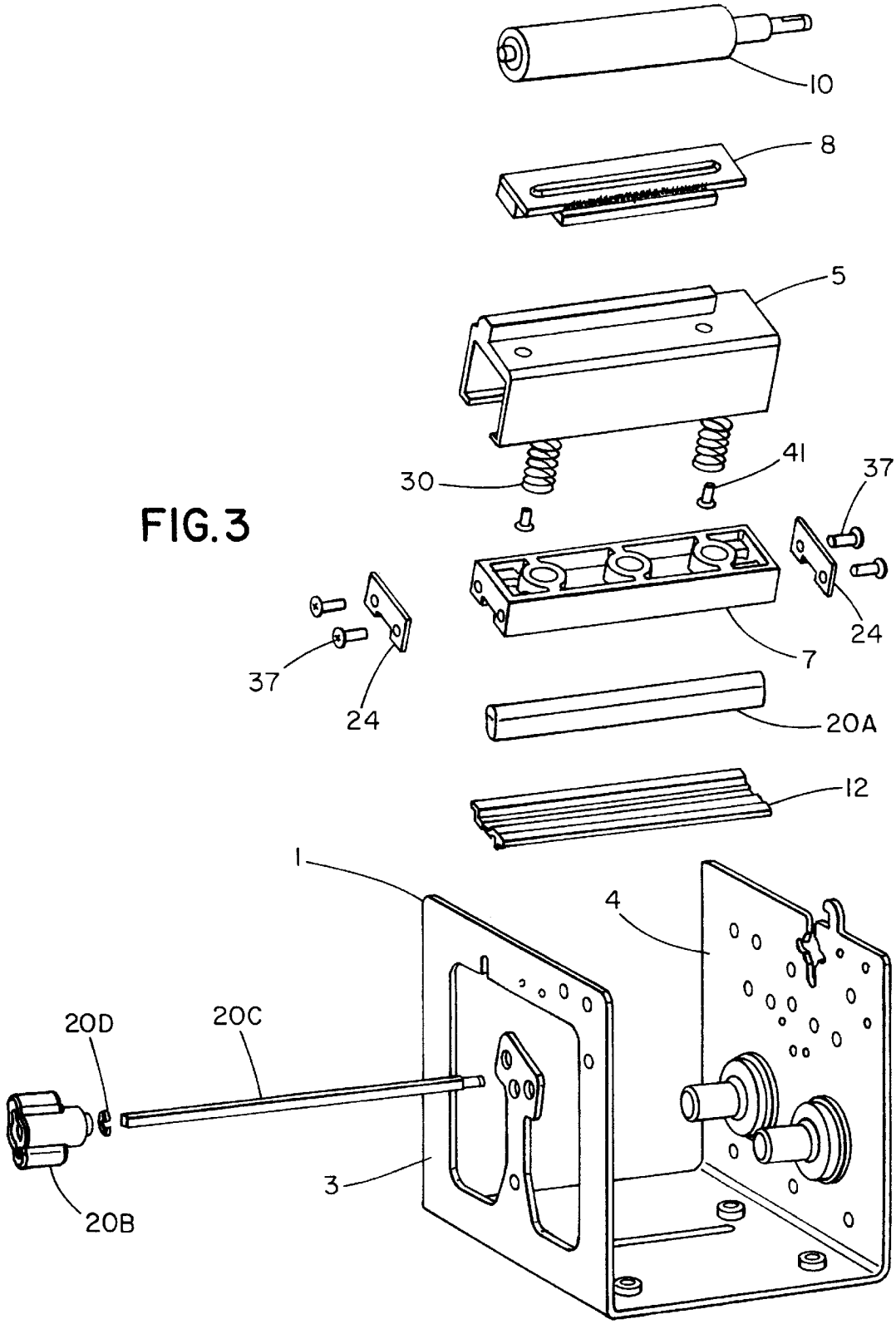
FIG. 3 is an exploded perspective view of a printhead mechanism assembly in accordance with the claimed invention.

Referring now to the drawings, FIG. 1 shows a typical thermal printhead mechanism of the type employing the present invention. The thermal printhead mechanism includes a spring channel 7, a top bracket 5, and a printhead 8. In the preferred embodiment of the claimed invention, the thermal printhead mechanism shown in FIG. 1. also includes a bottom bracket 12 and a cam 20 and is mounted to a front mounting plate 1 adjacent to a platen roller 10 as shown in FIGS. 2 and 3.

The thermal printhead mechanism and cam assembly shown in FIG. 1 is designed to support the top bracket 5 on both ends to insure that the printhead 8, which is mounted on the top bracket 5, is precisely aligned in parallel to the platen roller 10. The printhead 8 is preferably a two inch wide, five volt, 203 dots per inch, thick film thermal printhead that is widely available in the prior art. The printhead 8 is preferably mounted on the top bracket 5 using two screws 41.

The spring channel 7 is stationary and is preferably supported by four steel pins or screws 37 that attach to both legs 3,4 of the preferably U-shaped front mounting plate 1. The spring channel 7 can be made from almost any material, but is preferably an injection molded part made from glass filled PTFE lubricated nylon or the equivalent. The spring channel 7 is further adapted to receive or support a resilient material, such as a compression spring, between the spring channel 7 and the top bracket 5.

In the preferred embodiment of the claimed invention, a plurality of compression springs 30 are equally spaced between the spring channel 7 and the top bracket 5 in order to bias the printhead 8 toward the platen roller 10 and maintain the proper roller pressure on the media as it is pulled across the printhead 8. While any resilient material could be used by one skilled in the art to bias the printhead 8 toward the platen roller 10, compression springs preloaded by approximately 0.020" to provide a four pound force is preferable for maintaining the highest print quality. Using such compression springs 30 in the spring loaded movement between the top bracket 5 and the spring channel 7 allows the printhead 8 to float on the spring loaded movement and simultaneously and automatically adjust in the vertical direction for varying thicknesses of media ranging from 0.003 inches to 0.030 inches thick and in the horizontal direction for uneven media. Such bi-direction adjustments have the effect of maintaining a uniform contact between the printhead and the media and creating a uniform print line that cannot be attained with a fixed or pivoting printhead that is currently known in the prior art.

One embodiment of the claimed invention also provides for the use of a cam 20. The cam 20 is preferably housed in a bottom bracket 12 to provide a linear movement up to approximately 0.100 inches to allow a user to load the thermal printer with a media and ribbon cassette (not shown). The cam 20 will have an integral knob 20B, cam rod 20C, and cam bar 20A and will either lock or un-lock a ribbon cartridge (not shown) when it is rotated. When a cam 20 and bottom bracket 12 are utilized, the top bracket 5 is preferably an extruded aluminum piece formed into a U-shaped configuration having two legs, the end of each leg having an inwardly turned lip. Meanwhile, the bottom bracket 12 is preferably a molded piece that is formed into a U-shaped configuration having two legs, but with the end of each leg having an outwardly turned lip. The lips of the top bracket 5 support the lips of the bottom bracket 12, forming a channel that supports the cam bar 20A. Those skilled in the art should recognize that the cam and bottom bracket are not necessary for the spring channel 7 to support the top bracket 5 and printhead 8 and that many other types of cams could be utilized to achieve the same results.

Figure 4:
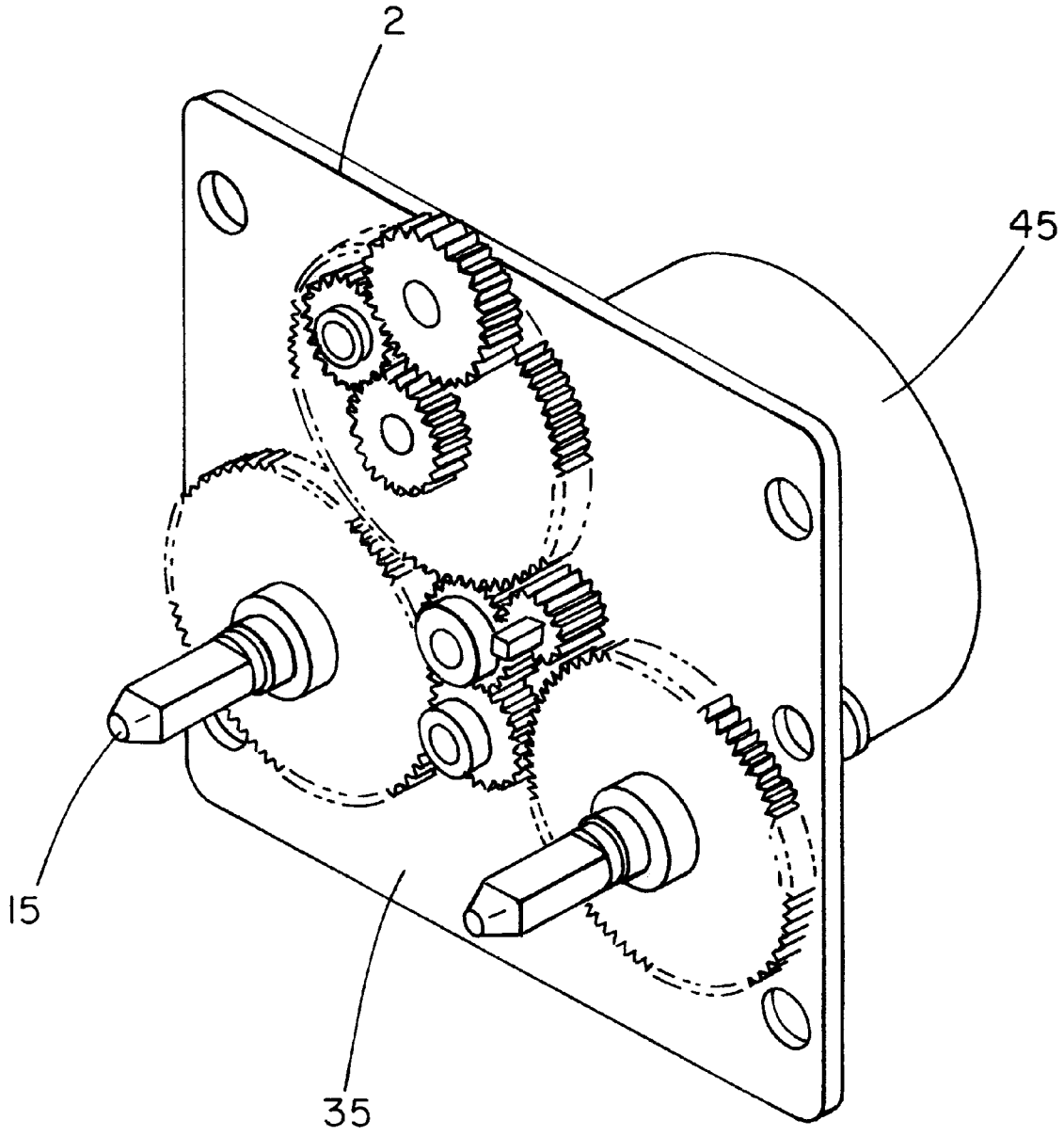
FIG. 4 is a perspective view of a backplate assembly in accordance with the claimed invention.

The front mounting plate 1 shown in FIGS. 2 and 3 is preferably a stamped metal part using CRS material with zinc plating that is formed into a U-shaped configuration having two legs 3,4. As shown in FIGS. 2, 3, and 4, the general function of the front mounting plate 1 is to provide a compact integral unit that supports the spring channel 7, platen roller 10, and cam 20 as well as the stepper motor 45 and gear train 35 of a thermal printer. In fact, in the thermal printhead mechanism of the claimed invention, only the platen roller 10 and the spring channel 7 are mounted to the front mounting bracket 1. The platen roller 10 is preferably constructed of a silicone rubber that is insert molded on a steel shaft and ground after molding. As shown in FIG. 3, the spring channel 7 is mounted on the legs 3,4 of the front mounting plate 1 using a wear plate 24 and two screws 37 at each end of the spring channel 7. Meanwhile, the remaining elements of the claimed thermal printhead mechanism invention are moveably mounted and supported by the fixed spring channel 7, and the printhead is thus allowed to "float" by not being secured to any structure.

As shown in FIGS. 3 and 4, the front mounting plate 1 also supports a back plate 2, a motor 45, and a gear train 35. During operation of a thermal printing device incorporating the claimed thermal printhead mechanism, one electronically controlled D.C. stepper motor 45 is used to provide the mechanical drive energy that is transferred through the gear train 35 to the roller 10 and the ribbon clutch drive 15 that is used to drive a spool in a ribbon cartridge (not shown). The ribbon clutch drive 15 is preferably reversible in order to reduce label waste by allowing the label and ribbon to back-up before printing. The ribbon clutch drive 15 also has a clutch and brake system incorporated on each ribbon gear and ribbon drive post. The ribbon drive clutch 15 can be installed for either clockwise or counterclockwise motion, and transmits only the required torque from the stepper motor 45 to the ribbon spool to maintain proper tension on the ribbon. The brake, preferably a simple compression spring or a felt pad, provides the required amount of restraining torque on the unwind spool to maintain proper tension on the ribbon, thereby preventing wrinkles.

It should be understood that the illustrated embodiments are exemplary only and should not be taken as limiting the scope of the present invention. The claims should not be read as limited to the order or elements unless stated to that effect. Therefore, all embodiments that come within the scope and spirit of the following claims and equivalents thereto are claimed as the invention.

We claim:

1. A thermal printhead mechanism comprising:

a spring channel fixed in a stationary location;

a pair of independent resilient members supported on said spring channel;

a top bracket movably supported on said pair of independent resilient members, a first point of said top bracket being supported by a first of said pair of independent resilient members and a second point of said top bracket being supported by a second of said pair of independent resilient members; and a printhead secured to said top bracket;

wherein said printhead secured to said top bracket may translate toward and away from said fixed spring channel by uniform expansion and contraction of said pair of independent resilient members to accommodate differing media thicknesses and may also rotate such that said first and second points of said top bracket are at different distances from said fixed spring channel by differential expansion and contraction of said pair of independent resilient members to accommodate media of non-uniform thickness.

2. A thermal printhead mechanism in accordance with claim 1 wherein said top bracket is formed in a generally U-shaped configuration.

3. A thermal printhead mechanism in accordance with claim 1 wherein at least one of said independent resilient members is a compression spring.

4. A thermal printhead mechanism in accordance with claim 1 further including a bottom bracket supported by said top bracket.

5. A thermal printhead mechanism in accordance with claim 4 further including a cam mechanism disposed between said spring channel and said bottom bracket.

6. A method of maintaining a substantially uniform contact pressure between a platen roller and a printhead secured to a top bracket when a print medium of uneven thickness is inserted therebetween, said method comprising the following steps:

securing a spring channel in a fixed location;

supporting a pair of independent resilient members on said spring channel; and supporting said top bracket on said pair of independent resilient members, a first point of said top bracket being supported by a first of said pair of independent resilient members and a second point of said top bracket being supported by a second of said pair of independent resilient members;

wherein said printhead secured to said top bracket may translate toward and away from said fixed spring channel by uniform expansion and contraction of said pair of independent resilient members to accommodate differing media thicknesses and may also rotate such that said first and second points of said top bracket are at different distances from said fixed spring channel by differential expansion and contraction of said pair of independent resilient members to accommodate media of non-uniform thickness.

7. A method in accordance with claim 6 wherein said top bracket is formed in a generally U-shaped configuration.

8. A method in accordance with claim 6 wherein at least one of said independently resilient members is a compression spring.

* * * * *